US006382265B2

(12) United States Patent
Weckerle

(10) Patent No.: US 6,382,265 B2
(45) Date of Patent: May 7, 2002

(54) METHOD AND DEVICE FOR FILLING DOUBLE-WALL RECEPTACLES

(76) Inventor: Peter Weckerle, Holzhofstrasse 26, D-82362 Weilheim (DE)

( * ) Notice: Subject to any disclaimer, the term of this patent is extended or adjusted under 35 U.S.C. 154(b) by 0 days.

(21) Appl. No.: 09/776,622

(22) Filed: Feb. 2, 2001

(30) Foreign Application Priority Data

Mar. 1, 2000 (DE) ..... 100 09 990

(51) Int. Cl.[7] ..... B65B 1/04
(52) U.S. Cl. ..... 141/9; 141/100; 141/114
(58) Field of Search ..... 141/2, 9, 18, 113, 141/114, 100, 103, 104, 105, 313, 314; 53/410, 469, 474

(56) References Cited

U.S. PATENT DOCUMENTS 1,676,734 A * 7/1928 Hopkins
5,775,386 A * 7/1998 Connan

* cited by examiner

*Primary Examiner*—Steven O. Douglas
(74) *Attorney, Agent, or Firm*—Cantor Colburn LLP

(57) ABSTRACT

The invention relates to a method and a device for filling a double-wall receptacle, more particularly a double-wall tube. For this purpose the tube features an inner and outer chamber which are filled at an open axial end of the tube with a solid, fluid or pasty bulk mass. During filling the inner wall and/or the outer wall is deformed at least in the portion of the open axial end of the tube at at least one point transversely to the axial direction so that the distance between the inner wall and the outer wall at at least one location of the circumferential portion of the outer chamber is larger than in the original non-deformed circumferential portion. Accordingly a filler nozzle is inserted into the outer chamber at the location of the enlarged distance between inner wall and outer wall, the outer diameter of the filler nozzle being larger than the distance between said inner wall and outer wall in the original non-deformed circumferential portion.

16 Claims, 2 Drawing Sheets

METHOD AND DEVICE FOR FILLING DOUBLE-WALL RECEPTACLES

TECHNICAL FIELD OF THE INVENTION

The invention relates to a method for filling a double-wall receptacle, more particularly a double-wall tube, with a solid, fluid or pasty bulk mass, whereby the two chambers of the receptacle are filled at an axially open end of the receptacle. The invention relates likewise to a device for filling a double-wall receptacle in accordance with the preamble of claim 5.

DESCRIPTION OF THE RELATED ART

Many applications call for packaging two solid, fluid or pasty bulk material components which are not allowed to intermingle during storage and are not mixed or made use of together until final application. A receptacle suitable for this purpose comprises a double-wall resulting in an inner chamber and outer chamber separated from each other, one example of which is a double-wall tube. For filling the chambers the tube is open at one axial end located opposite the discharge end, i.e. the actual tube opening. Thus, a filler nozzle for filling the chamber with a desired material component may be inserted at this open end into the corresponding chamber. Whilst the inner chamber features a large opening diameter, only a narrow edge portion remains for filling the outer chamber, since the outer chamber is defined on the inner side by the inner wall, of course. One problem in this arrangement is that for filling the outer chamber the filler nozzle is restricted to the spacing of the outer wall from the inner wall as regards its outer diameter. This results in the orifice of this filler nozzle or the thickness of an annular nozzle being corresponding small, as a result of which the filling procedure for the outer chamber is relatively slow. In addition to this problems materialize in inserting the filler nozzle into the outer chamber when a nozzle having a relatively large orifice is to be made use of, this being the reason why the size of the orifice needs to be smaller than the spacing of the inner wall from the outer wall.

SUMMARY OF THE INVENTION

It is thus the object of the invention to provide a method which eliminates the aforementioned disadvantages and permits speedy filling of the receptacle. In addition it is an object of the invention to provide a device by means of which a double-wall receptacle can be quickly filled.

The present invention provides a method for filling a double-wall receptacle which includes an inner chamber surrounded by an inner wall and an outer chamber surrounding the inner chamber defined on an inner side by the inner wall and on an outer side by the outer wall of the receptacle, and is open at one axial end for filling. The method comprises deforming the inner wall and/or the outer wall at least in a portion of the open axial end of the receptacle at at least one point transversely to the axial direction, and inserting at least one filler nozzle into the outer chamber at a location of an enlarged distance between inner wall and outer wall.

Due to the invention the inner and/or outer wall is deformed at least in the region of the open axial end of the double-wall receptacle at at least one point transversely to its axial direction. As a result of this the spacing between the inner and outer wall is enlargened at at least one location in the circumferential portion of the outer chamber so that at the location of the largest spacing a filler nozzle can be introduced into the outer chamber, the outer diameter of which is larger than the spacing between the inner wall and outer wall in the original non-deformed circumferential portion. In this arrangement the wall defining each of the chambers may be deformed from without or within, i.e. permitting a force to act on the corresponding defining wall in the direction of the longitudinal centerline of the tube and/or away from the longitudinal centerline of the tube to obtain the desired deformation of the inner or outer wall respectively.

It is now possible by means of the invention to suitably provide a nozzle also for filling the outer chamber which has a larger orifice than would be possible for a non-deformed defining wall of the outer chamber, thus enabling the filling procedure for the outer chamber dictating the filling speed and thus the filling procedure in all to be accelerated.

In one advantageous aspect of the method a body is inserted into the inner and/or outer chamber, the shape of the body dictating the deformation of the inner or outer wall respectively. The degree of deformation in this arrangement is advantageously made dependent thereof how far the body is inserted into the chamber. In the filling procedure a narrow end of the body is first inserted into the inner and/or outer chamber. When the body is then urged deeper into the chamber, it deforms the defining wall of the chamber increasingly and the nozzle can then progress further into the chamber where the spacing between the inner and outer wall has been increased by the deformation. A further advantage of inserting a body into the inner and/or outer chamber consists of the double-wall receptacle being maintained in a fixed position by this body during filling.

In a further advantageous embodiment of the method it is possible to insert a body into the inner and/or outer chamber, the shape of the body being variable. The inner and/or outer wall is then first deformed by the change in shape of the inserted body after the body has attained its final position in the corresponding chamber.

The method in accordance with the invention in this arrangement is not restricted to a specific number of points of deformation. Thus, the double-wall tube can be deformed at two points of the inner wall which are preferably spaced away from each other by 180° relative to the longitudinal centerline of the tube. Likewise, the tube may be deformed to advantage at three points of the inner wall each of which is then spaced 120° away from this longitudinal centerline.

The filling device in accordance with the invention then comprises an element or a body which deforms the inner and/or outer wall at least in the region of the open axial end of the receptacle at at least one point transversely to the axial direction. This may be e.g. an element which is forced against the receptacle from without. Preferably this element is a body which is inserted into the inner and/or outer chamber to deform the inner and/or outer wall. All that is important for the deformation in this arrangement is that the body has a shape in the plane perpendicular to the longitudinal centerline of the tube which is otherwise relative to the defining wall of the chamber to be filled, as a result of which the spacing between the inner wall and the outer wall at at least one location of the circumferential portion is larger than in the original non-deformed circumferential portion. Because of this, the filling device in accordance with the invention comprises a filler nozzle, the outer diameter of which is larger than the spacing between the inner wall and the outer wall in the originally non-deformed circumferential portion of the outer chamber.

The body is suitable shaped conically in the longitudinal centerline of the direction of movement, similar to a cone or a wedge to ensure targetted insertion of the body into the inner and/or outer chamber.

It may be likewise of advantage to provide a device which varies the shape of the body so that the inner or outer wall respectively is first deformed by the change in shape of the inserted body. This may be, for example, a pneumatic device which causes the body to expand by a pressure generated in the interior of the body.

The body comprises preferably a cross-section which dilates the inner wall at two, three or fours points spaced away from each other at an angle of 180°, 120° or 90° to the longitudinal centerline of the body on insertion of the body into the inner chamber. Accordingly, the device comprises two, three or four filler nozzles for filling the outer chamber inserted into the outer chamber at the locations precisely between the two, three or four end points.

In another advantageous further embodiment of the invention the nozzle for filling the inner chamber and/or the one or all nozzles for filling the outer chamber is/are integrated in the body, it then being possible to insert the body as well as all filler nozzles with no problem into the chambers of the receptacle in a single operation, the receptacle simultaneously being centered.

BRIEF DESCRIPTION OF THE DRAWINGS

The invention will now be detailed by way of an example with reference to the schematic drawings in which.

DETAILED DESCRIPTION OF THE PREFERRED EMBODIMENT

Figure 1A:
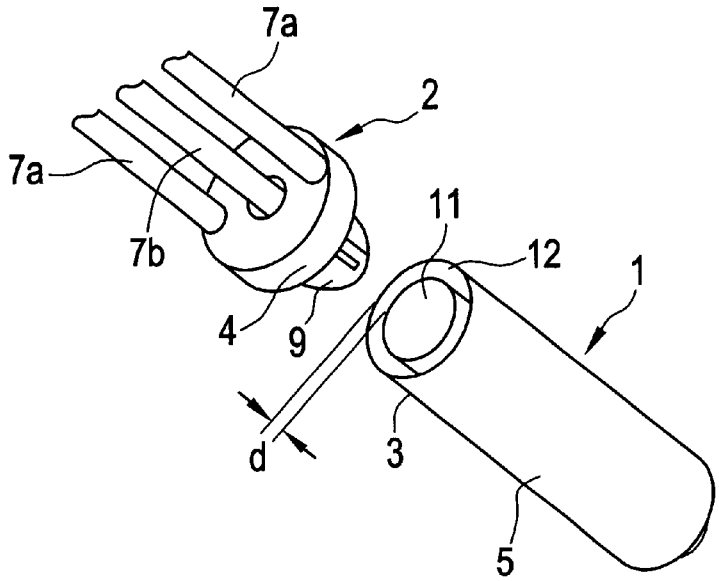
FIG. 1*a* is a view in perspective of part of the filling device including a double-wall tube to be filled.

Referring now to FIG. 1*a* there is illustrated in perspective the tube 1 to be filled including a filling device 2. The inner chamber 11 of the tube is separated from the outer chamber 12 by an inner wall 3. Located between this inner wall 3 and outer wall 5 of the tube is the outer chamber 12. The inner or outer wall respectively in this illustration is shown still non-deformed, by the inner wall being spaced away from the outer wall by the distance d. It is obvious from this illustration that the outer diameter of the filler nozzle 7*a* for the outer chamber is defined by the small distance of the inner wall from the outer wall. For filling the tube a body 9 including a nozzle 7*b* for the inner chamber 11 and two further nozzles 7*a* for the outer chamber 12 is inserted into the tube 1, it being irrelevant in this arrangement whether the tube is moved towards the filling device or vice-versa. The body 9 features a conical structure to permit targetted insertion of the body into the tube 1, i.e. first the body 9 with the nozzle 7*b* inserted into the inner chamber and the nozzle 7*a* first gaining access to the outer chamber after the inner wall 3 of the tube has been sufficiently deformed. In this aspect the nozzles 7*a,* 7*b* as well as the body 9 are integrated in an annular element 4 maintaining the nozzles and body 9 fixedly spaced away from each other.

Figure 1B:
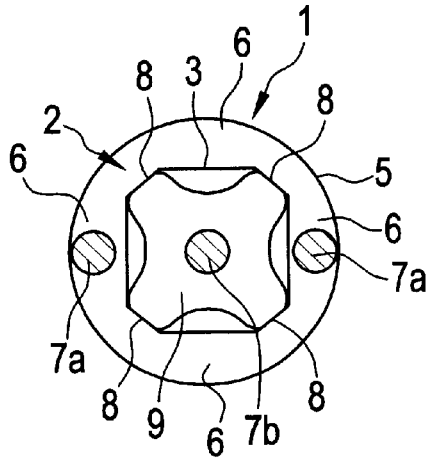
FIG. 1*b* is a cross-section through the tube with the filling device as shown in FIG. 1*a* depicted in the inserted position.

Referring now to FIG. 1*b* there is illustrated a cross-section in an axial plan view through the tube 1 including the body 9 as shown in FIG. 1*a* and the nozzles 7*a,* 7*b* in the inserted condition. It is evident from this illustration that the body 9 dilates the inner wall 3 of the tube 1 at four locations 8 in such a way that due to the deformation of the inner wall four locations 6 materialize at which the spacing of the inner wall from the outer wall is enlarged. At two of this total of four locations 6 two nozzles 7*a* for filling the outer chamber 12 are inserted.

Figure 2:
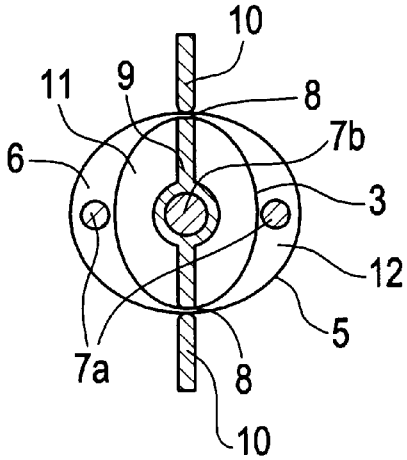
FIG. 2 is a cross-section through a tube including part of an advantageous aspect of the filling device in the inserted position.

Referring now to FIG. 2 there is illustrated in a partly sectioned axial plan view the tube 1 including an advantageous aspect of a body of the filling device. Analogous to the situation as shown in FIG. 1*b* in this Figure the body 9 of the filling device is located in a condition in which it is inserted into the inner chamber 11 of the tube 1. In this arrangement the body 9 deforms the inner wall 3 of the tube 1 at two points 8 spaced away from each other by 180° relative to the longitudinal centerline of the tube from which at these two points 8 the inner wall 3 is urged away. In addition the filling device comprises two further elements 10 which urge the outer wall 5 at two points in the direction of the longitudinal centerline of the tube in line with the locations 8 for the inner wall 3. The deformation of the inner wall 3 due to the body 9 and the deformation of the outer wall 5 due to the elements 10 thus cooperate to create at two locations 6 a maximum possible spacing between the inner and outer wall for the filler nozzle 7*a*. In this arrangement the elements 10 may be moved along the longitudinal centerline of the tube, they then featuring to advantage, analogous to the body 9, a conical profile so that the degree of the deformation of the outer wall depends on how far the elements 10 are moved along the longitudinal centerline of the tube. It is just as possible for the elements 10 to be moved from one side perpendicular to the longitudinal centerline of the tube. At the locations 6 it is now possible to introduce filler nozzles 7*a* whose outer diameter is larger than the distance d between the inner wall and outer wall in the original non-deformed circumferential portion.

Figure 3:
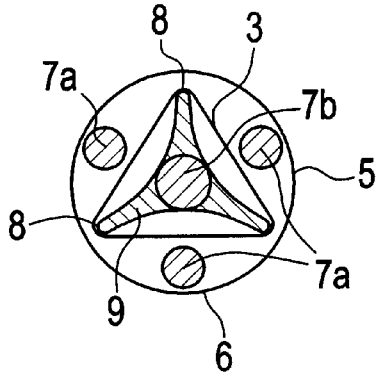
FIG. 3 is a cross-section through a tube including part of another advantageous aspect of the filling device in the inserted position and FIG. 4 is a cross-section through a filling device configured as a filler port including two bodies for deforming the inner and outer wall of a double-wall tube.

Referring now to FIG. 3 there is illustrated an advantageous further embodiment of the invention including a body 9 dilating the inner wall 3 of a double-wall tube at three points of deformation 8 located 120° spaced away from each other relative to the longitudinal centerline of the tube. In this arrangement the locations 6 materialize between the points of deformation 8 at which the distance between the inner wall 3 and the outer wall 5 is enlarged. Correspondingly, three filler nozzles 7*a* may be inserted into the outer chamber simultaneously. Here too, the outer diameter of the filler nozzle 7*a* is larger than the distance between the non-deformed inner and outer wall.

It will be appreciated that the invention is not restricted to the two examples as discussed, since many possibilities exist for deforming the inner and/or outer wall of a double-wall receptacle. To illustrate a combination of deforming the inner wall with the outer wall it is possible with reference to FIG. 2 to splay the outer wall of the tube just like the inner wall away from the longitudinal centerline of the tube, i.e. in a direction turned through 90° relative to the direction of deformation of the inner wall. In the same way it is possible to also apply the method to receptacles comprising more than two defining walls. It is to be noted that the drawings illustrate the invention merely schematically. Thus, the outer diameters of the filler nozzles 7*a,* 7*b* for the inner and outer chamber may differ from each other. As a rule the filler nozzle 7*b* for the inner chamber 11 will have a larger diameter than that of the filler nozzle 7*a* for the outer chamber 12.

Figure 4:
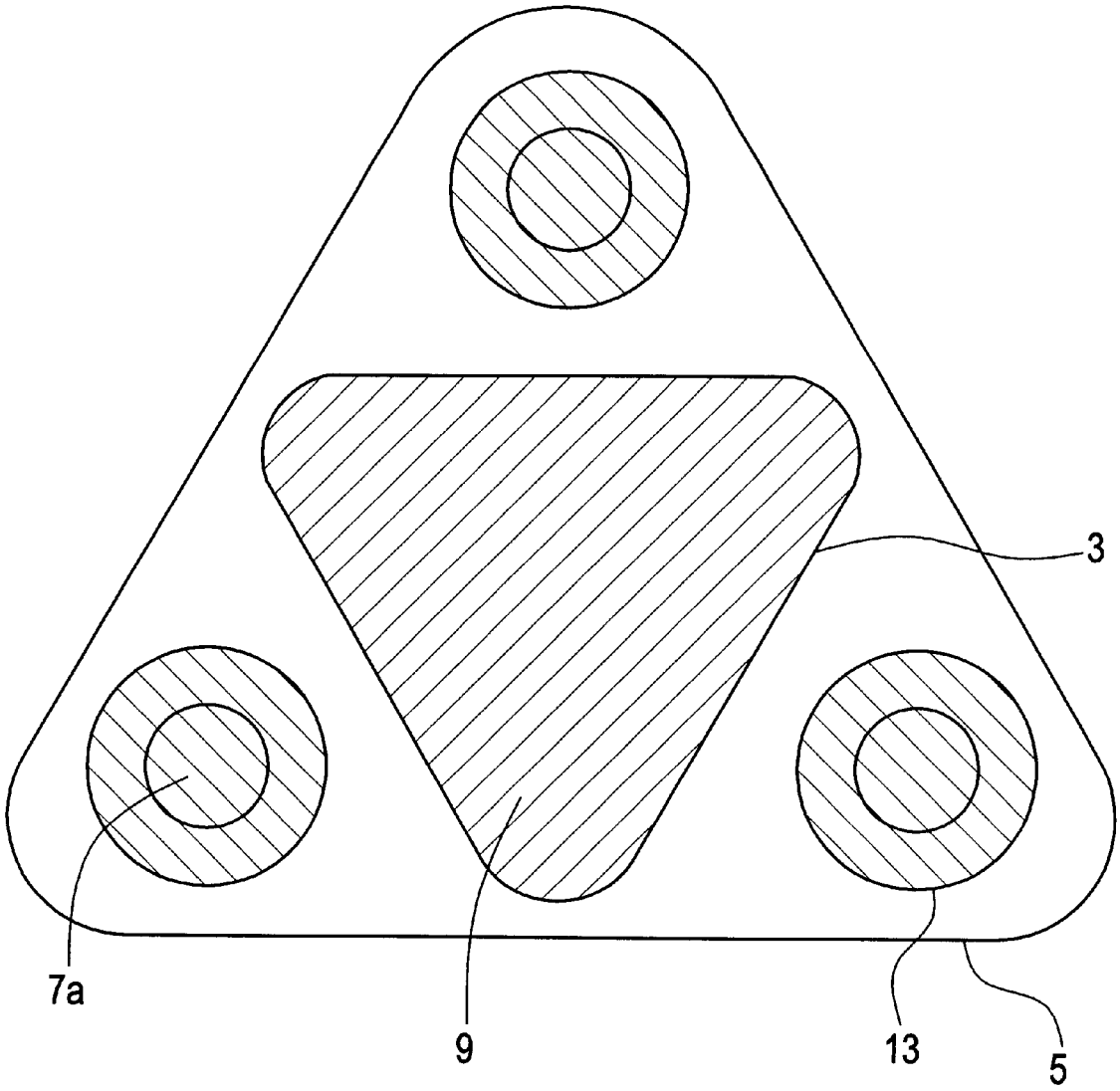

Referring now to FIG. 4 there is illustrated a filler connection for a double-wall tube including an inner body 9 for deforming the inner wall 3 and an outer body 13 for deforming the outer wall 5. The inner and outer body 9, 13 have the shape of two isosceles triangles offset from each other by 180° resulting in three large filling portions in which the nozzles 7*a* for the outer chamber are arranged. The nozzle 7*b* for the inner chamber may be arranged in the inner body 9. It will readily be appreciated that the filler connection is conically vertexed (not shown) to facilitate its insertion into the double-wall tube. Filling the inner chamber may also be done in a separate procedure.

It will likewise be appreciated that combinations of the features as shown in the various Figures are readily possible and also intended.

What is claimed is:

1. A method for filling a double-wall receptacle with a solid, fluid or pasty bulk mass, said double-wall receptacle including an inner chamber surrounded by an inner wall and an outer chamber surrounding said inner chamber defined on an inner side by said inner wall and on an outer side by an outer wall of said receptacle, said double-wall receptacle being open at one axial end for filling, the method comprising:

deforming said inner wall and/or said outer wall at least in a portion of said open axial end of said receptacle at at least one point transversely to said axial direction so that a distance between said inner wall and said outer wall at at least one location of a circumferential portion of said outer chamber is larger than in an original non-deformed circumferential portion;

inserting at least one filler nozzle into said outer chamber at said location of said enlarged distance between said inner wall and said outer wall, an outer diameter of said filler nozzle being larger than said distance between said inner wall and said outer wall in said original non-deformed circumferential portion.

2. The method as set forth in claim 1 wherein for deforming said inner wall and/or said outer wall a body is inserted into said inner and/or outer chamber, a shape of said body determining the deformation of said inner or outer wall respectively.

3. The method as set forth in claim 2 wherein said shape of said body is designed to be variable so that said inner or outer wall respectively is deformed by a change in shape of said body inserted into said inner and/or outer chamber.

4. The method as set forth in claim 1 wherein said inner and/or outer wall is deformed at two or three points spaced away from each other by 180 or 120 degrees relative to a longitudinal centerline of said double-wall receptacle.

5. A device for filling a double-wall receptacle with a solid, fluid or pasty bulk mass, said double-wall receptacle including an inner chamber surrounded by an inner wall and an outer chamber surrounding said inner chamber defined on an inner side by said inner wall and on an outer side by an outer wall of said double-wall receptacle, said double-wall receptacle being open at one axial end for filling, said device comprising:

at least one filler nozzle for filling said outer chamber inserted between said inner wall and said outer wall at said open axial end;

a body for deforming said inner wall and/or said outer wall at least in the portion of said open axial end of said receptacle at at least one point transversely to said axial direction so that a distance between said inner wall and said outer wall at one location of a circumferential portion of said outer chamber is larger than an original non-deformed circumferential portion, wherein said at least one filler nozzle includes an outer diameter which is larger than said distance between said inner wall and said outer wall in said original non-deformed circumferential portion.

6. The filling device as set forth in claim 5 wherein said body has a shape which on insertion of said body into said inner chamber and/or between said inner wall and said outer wall of said receptacle determines a shape and degree of deformation.

7. The filling device as set forth in claim 6 said body further comprising a cross-section which dilates said inner wall at two, three or four points spaced away from each other at an angle of 180, 120, or 90 degrees to a longitudinal centerline of said body on insertion of said body into said inner chamber and said device further comprising two three or four filler nozzles for filling said outer chamber inserted into said outer chamber at locations between said two, there or four end points.

8. The filling device as set forth in claim 7 wherein said nozzle for filling said inner chamber and/or the at least one filler nozzle for filling said outer chamber is/are integrated in said body.

9. The filling device as set forth in claim 6 wherein said nozzle for filling said inner chamber and/or the at least one filler nozzle for filling said outer chamber is/are integrated in said body.

10. The filling device as set forth in claim 5 wherein said body includes a device enabling a shape of said body to be changed so that said inner or outer wall respectively is deformed by a change in shape of said body inserted into said inner and/or outer chamber.

11. The filling device as set forth in claim 10 said body further comprising a cross-section which dilates said inner wall at two, three or four points spaced away from each other at an angle of 180, 120, or 90 degrees to a longitudinal centerline of said body on insertion of said body into said inner chamber and said device further comprising two three or four filler nozzles for filling said outer chamber inserted into said outer chamber at locations between said two, there or four end points.

12. The filling device as set forth in claim 11 wherein said nozzle for filling said inner chamber and/or the at least one filler nozzle for filling said outer chamber is/are integrated in said body.

13. The filling device as set forth in claim 10 wherein said nozzle for filling said inner chamber and/or the at least one filler nozzle for filling said outer chamber is/are integrated in said body.

14. The filling device as set forth in claim 5 said body further comprising a cross-section which dilates said inner wall at two, three or four points spaced from each other at an angle of 180, 120, or 90 degrees to a longitudinal centerline of said body on insertion of said body into said inner chamber and said device further comprising two, three or four filler nozzles for filling said outer chamber inserted into said outer chamber at locations between said two, three or four end points.

15. The filling device as set forth in claim 14 wherein said nozzle for filling said inner chamber and/or the at least one filler nozzle for filling said outer chamber is/are integrated in said body.

16. The filling device as set forth in claim 5 wherein said nozzle for filling said inner chamber and/or the at least one filler nozzle for filling said outer chamber is/are integrated in said body.

* * * * *